US007681455B2

(12) United States Patent
Knoch et al.

(10) Patent No.: US 7,681,455 B2
(45) Date of Patent: Mar. 23, 2010

(54) METHOD AND DEVICE FOR MONITORING THE STATE OF THE PROTECTIVE COVERING OF A ROTARY FURNACE BURNER

(75) Inventors: Alexander Knoch, Lohmar (DE); Arno Heincke, Niederkassel (DE)

(73) Assignee: KHD Humboldt Wedag GmbH, Cologne (DE)

( * ) Notice: Subject to any disclaimer, the term of this patent is extended or adjusted under 35 U.S.C. 154(b) by 142 days.

(21) Appl. No.: 12/092,653

(22) PCT Filed: Nov. 8, 2006

(86) PCT No.: PCT/EP2006/010672

§ 371 (c)(1),
(2), (4) Date: May 5, 2008

(87) PCT Pub. No.: WO2007/054272

PCT Pub. Date: May 18, 2007

(65) Prior Publication Data

US 2008/0289430 A1 Nov. 27, 2008

(30) Foreign Application Priority Data

Nov. 11, 2005 (DE) ..... 10 2005 053 820

(51) Int. Cl.
*G01L 7/00* (2006.01)
*F23Q 9/00* (2006.01)

(52) U.S. Cl. ..... 73/700; 431/264

(58) Field of Classification Search ..... None
See application file for complete search history.

(56) References Cited

U.S. PATENT DOCUMENTS

| | | | | |
|---|---|---|---|---|
| 3,980,233 | A * | 9/1976 | Simmons et al. | 239/400 |
| 4,130,388 | A * | 12/1978 | Flanagan | 431/116 |
| 4,838,030 | A | 6/1989 | Cramer | |
| 5,569,029 | A * | 10/1996 | Poschl | 431/116 |
| 6,390,806 | B1 | 5/2002 | Dempsey et al. | |
| 2006/0207263 | A1 | 9/2006 | Stöcker et al. | |

FOREIGN PATENT DOCUMENTS

| | | | |
|---|---|---|---|
| DE | 38 27 591 | | 6/1989 |
| DE | 197 37 303 | | 3/1999 |
| DK | DD 231846 A | * | 1/1986 |
| EP | 1 473 517 | | 11/2004 |
| FR | 2 813 381 | | 3/2002 |
| JP | 2005351517 A | * | 12/2005 |

* cited by examiner

*Primary Examiner*—Lisa M Caputo
*Assistant Examiner*—Jermaine Jenkins
(74) *Attorney, Agent, or Firm*—Greer Burns Crain, Ltd

(57) ABSTRACT

A process and device for the reliable monitoring of the current condition of the protective jacket formed of fireproof material, in particular of a rotary tubular kiln burner lance, during operation of the kiln system. A compressed air ring main and/or an annular metal wire loop forming part of an electrical circuit extending around the circumference of the protective jacket are embedded in the fireproof compound of the protective jacket in the area of the burner tip, in which in the event of burning through of the ring main or metal wire loop, a connected pressure sensor or current sensor generates a monitoring signal.

12 Claims, 1 Drawing Sheet

METHOD AND DEVICE FOR MONITORING THE STATE OF THE PROTECTIVE COVERING OF A ROTARY FURNACE BURNER

BACKGROUND OF THE INVENTION

The invention concerns a process for monitoring the condition of the protective jacket of a burner, which consists of fireproof material, and in particular a burner lance for firing of a rotary tubular kiln for the production of cement clinker from raw powder. The invention also concerns a device for performing this process.

In a cement clinker production line, calcinated raw cement powder is converted into cement clinker in the sinter zone of a rotary tubular kiln. For the heating of the rotary tubular kiln, a long burner lance is inserted into the kiln outlet end through the stationary kiln outlet housing, at whose mouth fuels introduced into the lance burn by forming a burner flame. Instead of liquid or gaseous fuels, solid fuels are increasingly used for this purpose, in particular coal dust, but also pneumatically transportable waste fuels as secondary fuels.

The cement clinker is ejected in the red-hot condition via the stationary kiln outlet housing downwards onto a clinker cooler, usually a grid cooler, in which the cement clinker is cooled. In this process, part of the hot cooler air trapped in the kiln outlet housing is used for the combustion process as hot secondary air, which in the stationary kiln outlet housing flows from below into the rotary kiln end under flow direction. This secondary air, which is at a high temperature of 1100° C. or more, is charged with cement clinker dust. Apart from the kiln outlet housing, the burner lance in particular is exposed to mechanically abrasive and high thermo-chemical wear. The current practice of the technology is therefore to surround the meter-long lance with a protective jacket of fireproof material, as a rule a tamped fireproof compound (Brochure 8-100d "Rotary tubular kiln systems" of KHD Humboldt Wedag AG, Page 28, FIG. 3). Despite the use of such a protective jacket, the service life of a burner lance is not unlimited, even if it is equipped with its own air cooling. Damage to the fireproof material, particularly in the area of the burner tip, has previously not been able to be determined reliably enough during operation of the rotary tubular kiln. Such damage quickly leads to damage to the burner nozzle head, and thus to costly repair work to the burner. Replacement of a rotary kiln burner or its nozzle head results in undesirable interruptions in operation of the rotary kiln, and thus the operation of the complete cement clinker line, so that such a replacement should only be carried out when absolutely necessary.

SUMMARY OF THE INVENTION

The invention is therefore based on the task of developing a process and a device by means of which the current condition of the protective jacket of fireproof material, and in particular of the rotary tubular kiln burner lance, can be monitored safely and reliably during operation of the kiln system.

In the monitoring system described by the invention, a ring main extending around the circumference of the jacket, which consists of fireproof brick, or particularly of a tamped, formed compound, is embedded in the fireproof compound of the burner lance protective jacket in the area of the burner tip, by means of which damage to the protective jacket and the ring main at any point on the circumference generates a monitoring signal. If on the other hand individual thermo-elements distributed around the circumference were embedded in the protective jacket as temperature measurement elements, this would only enable monitoring at specific points, because damage to the fireproof compound due to detachment of pieces in the area between two neighboring temperature sensors could not be detected by means of a temperature increase. Thermo-elements would also be relatively expensive, would burn through in the event of severe damage to the fireproof compound and would then have to be replaced.

The ring main embedded in the fireproof compound of the burner lance protective jacket can be a thin-walled tubular ring main, containing gas, particularly air at over-pressure, in which the comparatively inexpensive tubular ring main burns through at the corresponding point on the circumference following damage to the fireproof compound. A pressure sensor measures the drop in pressure of the air and immediately generates the monitoring signal, e.g., a visual and/or acoustic signal in the control station of the cement works with the rotary kiln system.

In accordance with a further feature of the invention, the ring main embedded in the fireproof compound of the protective jacket can be an annular metal wire loop forming part of an electrical circuit, in which again the metal wire loop burns through at a point on the circumference in the event of severe damage to the protective jacket, breaking the electrical circuit and generating the monitoring signal.

In all variants described by the invention, sufficient time is allowed following generation of the monitoring signal, to shut down the rotary tubular kiln and replace the burner, before costly damage to the burner and/or other unplanned failures occur. When relining the fireproof compound, a new monitoring ring main is simply embedded.

BRIEF DESCRIPTION OF THE DRAWINGS

The invention and its further features and benefits are described in greater detail by means of the design examples shown in schematic form in the figures.

These show.

DETAILED DESCRIPTION OF THE PREFERRED EMBODIMENTS

Figure 1:
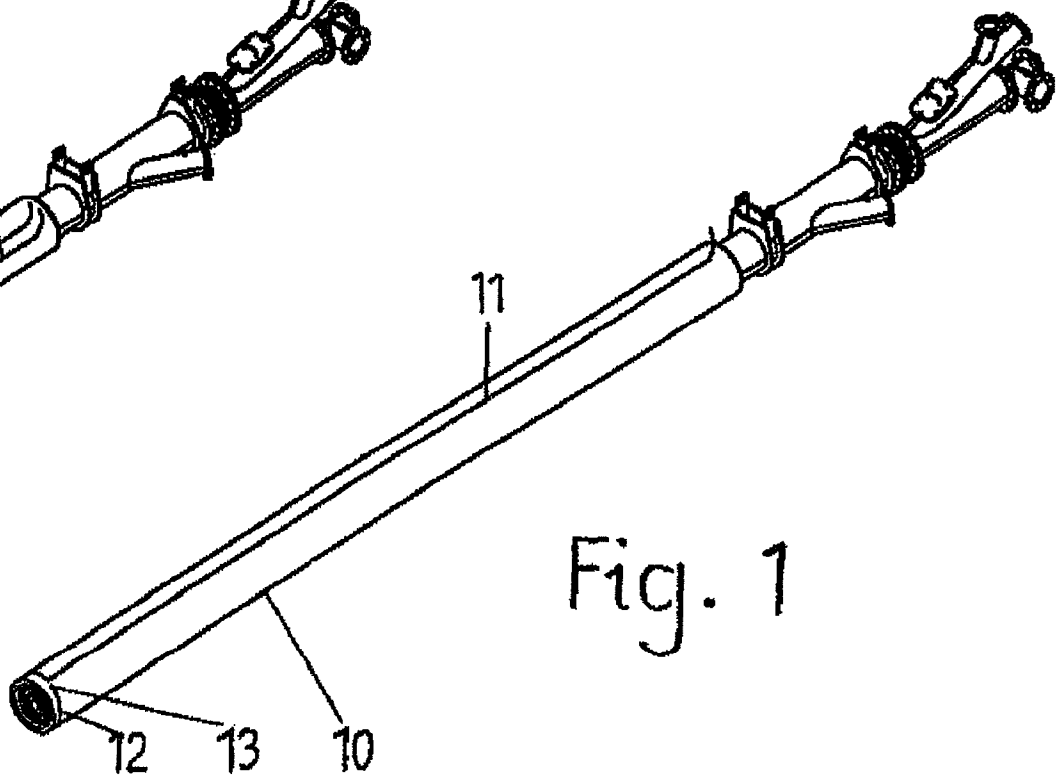
FIG. 1: Perspective view of a complete rotary kiln burner lance with monitoring of the condition of the protective jacket comprising fireproof compound using an embedded over-pressure air tubular ring main.

The burner lance shown in FIG. 1 has a relatively thick-walled protective jacket (10) of fireproof compound, in which a thin metallic over-pressure air line (11) is embedded, at a depth of approx. 30 mm, which in the area of the burner tip, ends in a tubular ring main (12), whose end is shown as (13). In this line (11), (12), air is maintained at a slight over-pressure, which could for example come from the primary air combustion air blower or the compressed air system of the cement works. In the normal case, no compressed air flows through the line (11). If the fireproof compound of the protective jacket (10) is damaged to any great extent at some point on the circumference during operation of the rotary kiln, the compressed air tubular ring main (12) arranged in the area of the burner tip burns through, causing an immediate drop in the air pressure in the compressed air line (11). A pressure sensor (not shown) connected to the compressed air line (11) measures the dropping pressure and generates a monitoring signal, before costly damage to the burner lance and/or other unplanned failures occur.

Figure 2:
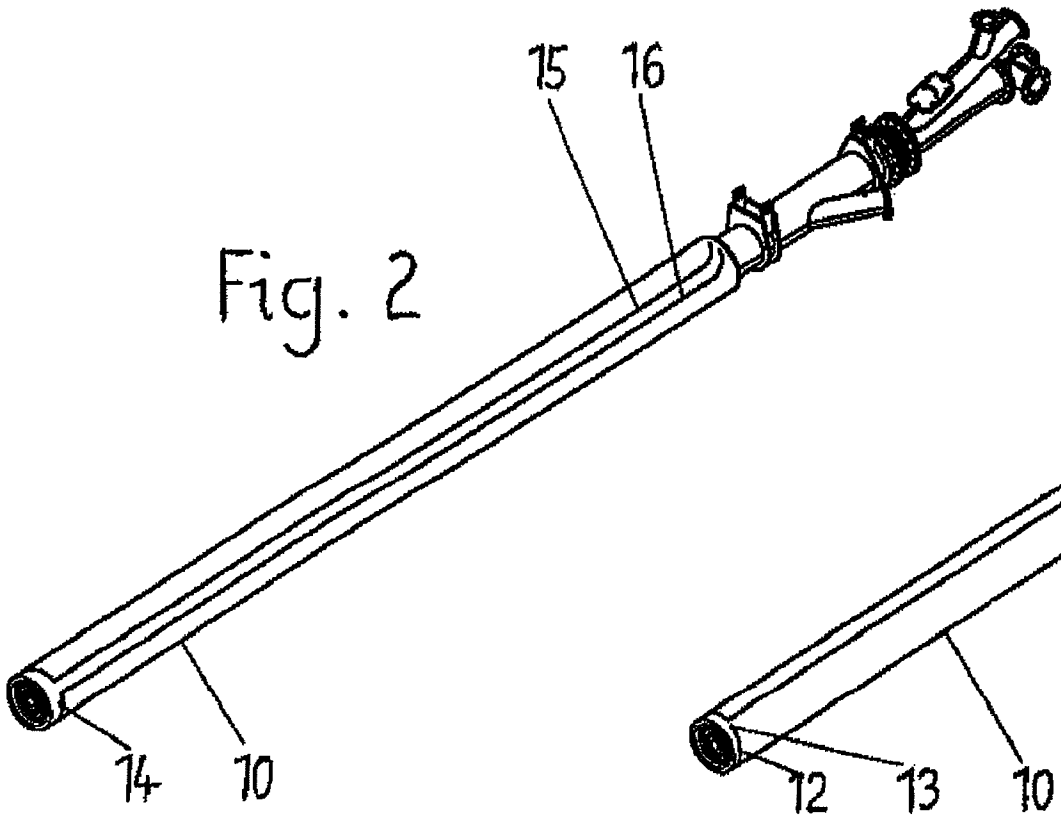
FIG. 2: Perspective view of a burner lance with monitoring of the condition of the protective jacket comprising fireproof compound in which a metal wire loop is embedded, forming part of an electrical circuit.

In the case of the burner lance of the design example shown in FIG. 2, a metal wire loop ring (14) consisting of iron fuse wire is embedded in the fireproof material of the protective jacket (10) in the area of the burner tip, which forms part of electrical circuit with lines (15) and (16). In the event of damage to the protective jacket (10), particularly in the highly-stressed area of the burner tip, the wire loop (14) burns through, and the electrical circuit is broken, by means of which a monitoring signal is again generated immediately by a current sensor.

The invention can be used not only for the monitoring of the condition of the fireproof compound in rotary kiln burners, but also for monitoring the condition of the fireproof material of other components subject to high mechanical and thermal/chemical stresses, such as the condition of immersion tubes of hot gas separating cyclones in cement works comprising ceramic material etc.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The invention claimed is:

1. A process for monitoring the condition of a protective jacket of a burner, which comprises fireproof material, and in particular a burner lance for firing of a rotary tubular kiln for the production of cement clinker from raw powder, comprising the steps of embedding a ring main extending around a circumference of the protective jacket in the fireproof material of the protective jacket in an area of a burner tip, and generating a signal in the event of damage to the protective jacket or the ring main at any point on the circumference.

2. A process in accordance with claim 1, wherein the ring main contains air at over-pressure, and wherein in the event of damage to the protective jacket and the burning of the tubular ring main at any point on the circumference, a pressure sensor measures a drop in air pressure and generates the monitoring signal.

3. A process in accordance with claim 1, wherein the ring main embedded in the protective jacket is an annular metal wire loop which forms part of an electrical circuit, and wherein in the event of damage to the protective jacket and burning through of the metal wire loop, the electrical circuit is broken and the monitoring signal generated.

4. A device for monitoring the condition of the protective jacket of a burner, which comprises fireproof material, and in particular a burner lance for firing of a rotary tubular kiln for the production of cement clinker from raw powder, comprising:

a compressed air ring main, or an annular metal wire loop forming part of an electrical circuit, extending around a circumference of the protective jacket being embedded in the fireproof material of the protective jacket in an area of a burner tip, and a connected pressure sensor or current sensor arrangement to generate a monitoring signal in the event of burning through of the ring main or metal wire loop.

5. A device in accordance with claim 4, wherein the metal wire loop comprises iron fuse wire.

6. A process for monitoring the condition of a fireproof material protective jacket of a burner lance having a burner tip at one end, comprising the steps of embedding a ring main extending around a circumference of the fireproof material of the protective jacket in the area of the burner tip, and generating a monitoring signal in the event of damage to the ring main at any point on the circumference.

7. A process according to claim 6, further comprising the steps:

introducing air at over-pressure into the ring main, sensing a pressure drop, with a pressure sensor, in the ring main in the event of damage to the tubular ring main at any point on the circumference, and generating a monitoring signal in the event of a sensed pressure drop.

8. A process according to claim 6, further comprising the steps:

providing an annular metal wire loop in the ring main to form part of an electrical circuit, sensing a current drop through the wire loop, in the event of damage to the wire loop, and generating a monitoring signal in the event of a sensed current drop.

9. A device for monitoring the condition of a protective jacket of a burner formed of fireproof material, comprising:

a circuit comprising one of a compressed air ring main forming part of a gas circuit and an annular metal wire loop forming part of an electrical circuit extending around a circumference of the protective jacket, being embedded in the fireproof material of the protective jacket in the area of a tip of the burner, and a connected sensor arranged to generate a monitoring signal in the event of damage to the circuit.

10. A device according to claim 9, wherein the circuit is an air ring main and the connected sensor is a pressure sensor.

11. A device according to claim 9, wherein the circuit is a metal wire loop and the connected sensor is a current sensor.

12. A device according to claim 9, wherein the metal wire loop comprises iron fuse wire.

* * * * *